US006148008A

United States Patent [19]

Okamoto

[11] Patent Number: 6,148,008

[45] Date of Patent: Nov. 14, 2000

[54] APPARATUS FOR RECEIVING BROADCASTING SIGNALS

[75] Inventor: Tadashi Okamoto, Kanagawa, Japan

[73] Assignee: Sony Corporation, Tokyo

[21] Appl. No.: 09/031,718

[22] Filed: Feb. 27, 1998

[30] Foreign Application Priority Data

Mar. 4, 1997 [JP] Japan ..... P09-048727

[51] Int. Cl.[7] ..... H04H 1/04

[52] U.S. Cl. ..... 370/486; 455/132

[58] Field of Search ..... 455/132, 133, 455/134, 135, 59, 188.1, 180.1; 370/334, 486, 487

[56] References Cited

U.S. PATENT DOCUMENTS 5,159,502 10/1992 Ejima et al. ..... 360/62
5,315,401 5/1994 Okada et al. ..... 386/104
5,584,051 12/1996 Göken ..... 455/68
5,588,022 12/1996 Dapper et al. ..... 375/216
5,949,813 9/1999 Hunsinger et al. ..... 375/200
5,956,624 9/1999 Hunsinger et al. ..... 455/65

*Primary Examiner*—Chau Nguyen
*Assistant Examiner*—Suibel M. H. Schuppner
*Attorney, Agent, or Firm*—Jay H. Maioli

[57] ABSTRACT

An apparatus for receiving broadcasting signals, which includes a digital audio broadcasting signal receiving portion for receiving a digital audio broadcasting signal to obtain a reproduced digital broadcasting sound signal, an analog audio broadcasting signal receiving portion for receiving an analog audio broadcasting signal to obtain a reproduced analog broadcasting sound signal, a variable delay portion for delaying the reproduced analog broadcasting sound signal obtained from the analog audio broadcasting signal receiving portion to have a variable delay time, and a signal matching control portion for controlling the variable delay portion to reduce a difference in delay time between the reproduced analog broadcasting sound signal obtained through the variable delay portion and the reproduced digital broadcasting sound signal obtained from the digital audio broadcasting signal receiving portion.

8 Claims, 4 Drawing Sheets

FIG. 2-A
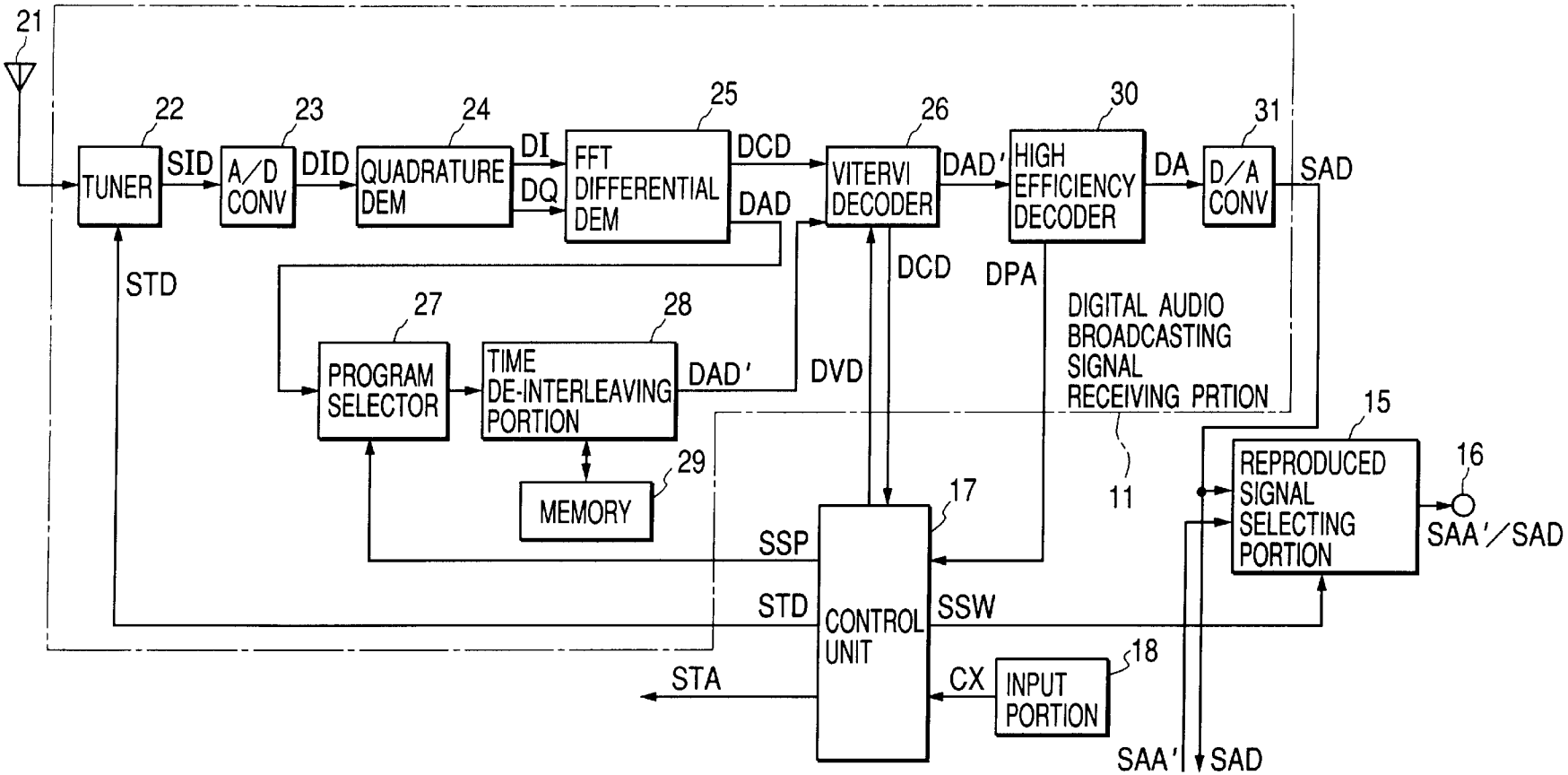

FIG. 2-B
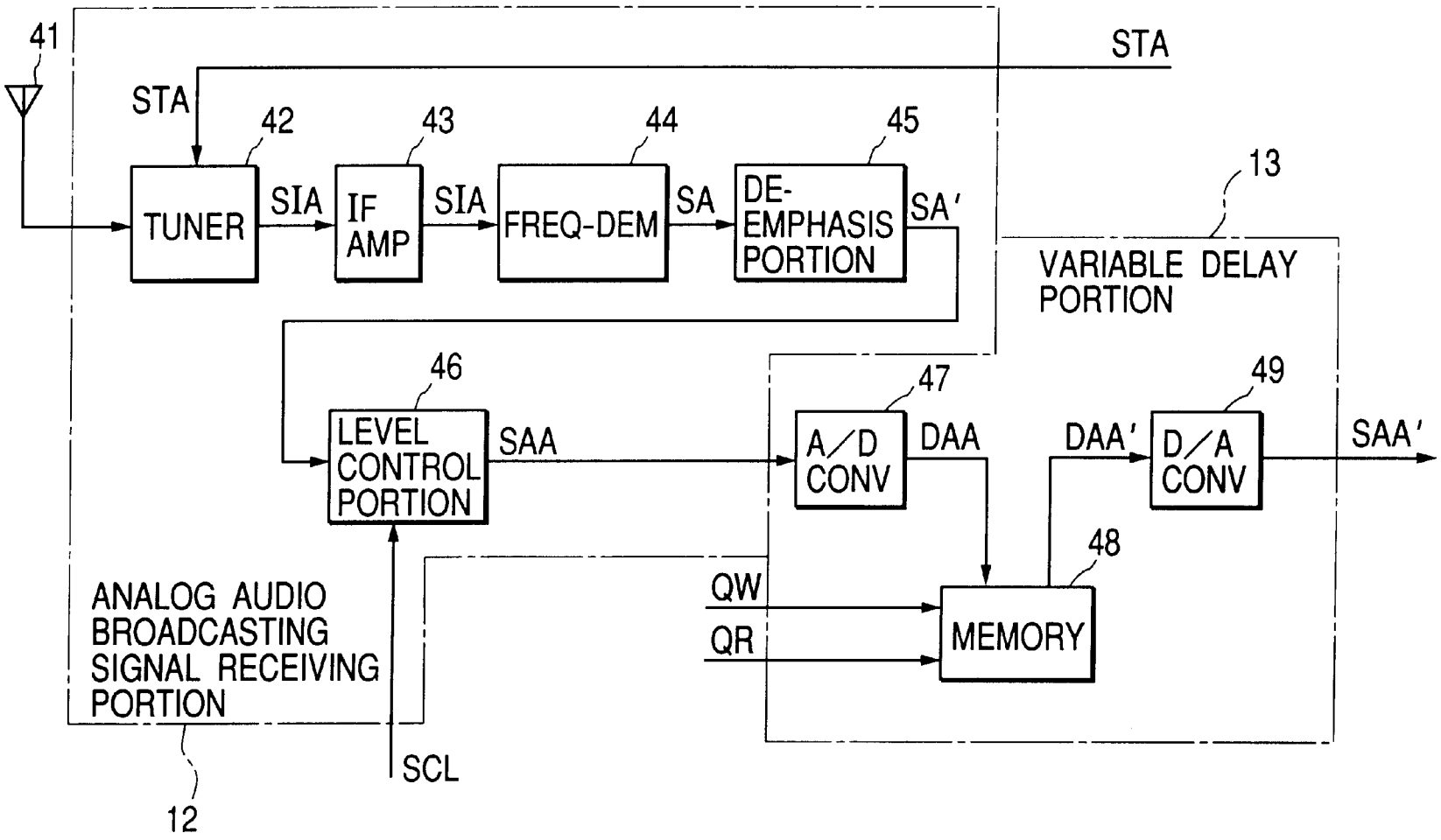

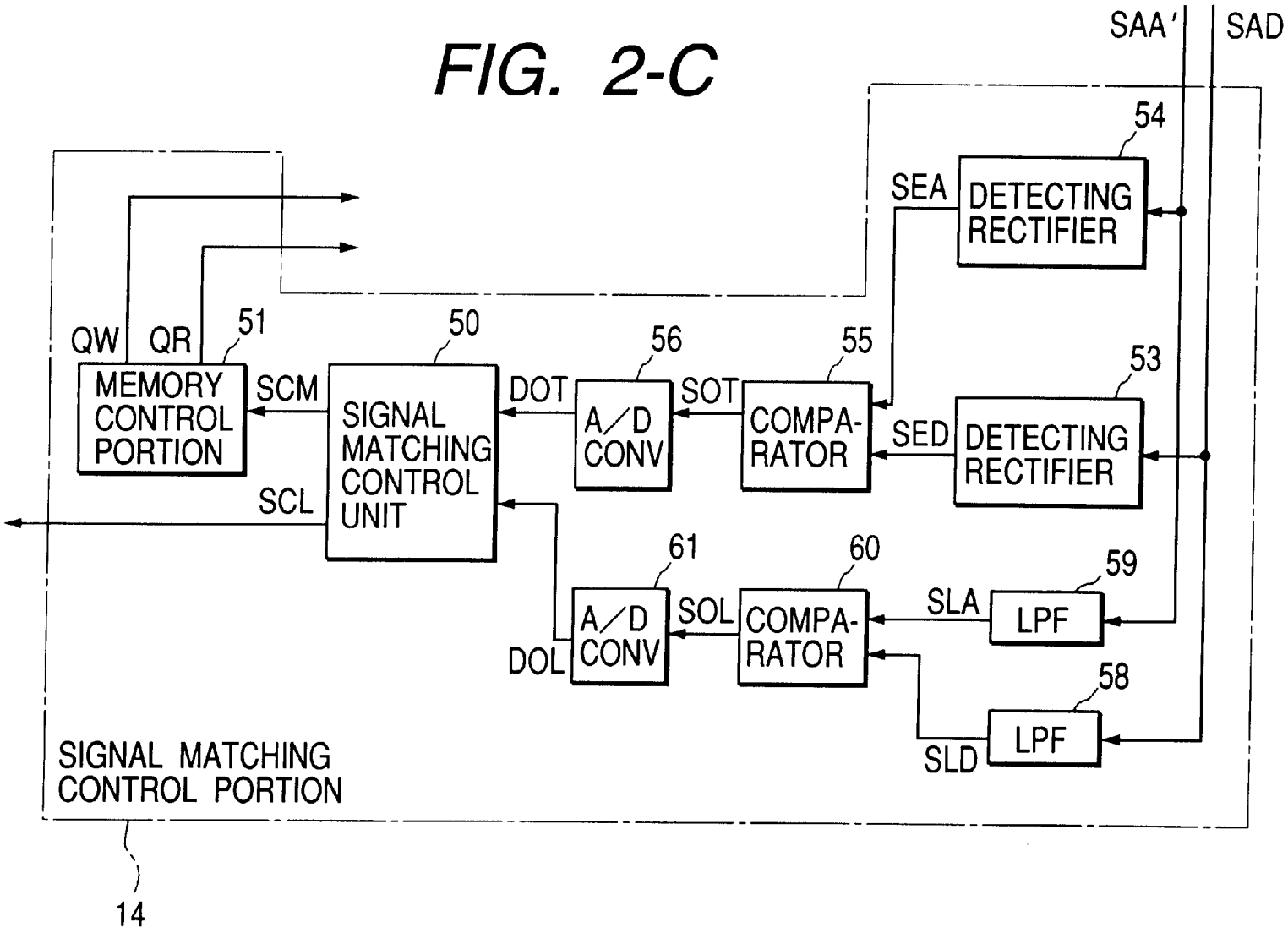
FIG. 2-C

APPARATUS FOR RECEIVING BROADCASTING SIGNALS

BACKGROUND OF THE INVENTION

1. Field of the Invention

The present invention relates generally to an apparatus for receiving broadcasting signals, and more particularly, to a broadcasting signal receiving apparatus which is operative to receive not only an analog audio broadcasting signal, such as an amplitude-modulated (AM) audio broadcasting signal or a frequency-modulated (FM) audio broadcasting signal, but also a digital audio broadcasting (DAB) signal for obtaining a reproduced sound signal.

2. Description of the Prior Art

Although an analog audio broadcasting system which includes an AM audio broadcasting system in which audio information signals are transmitted in the form of an AM audio information signal and a FM audio broadcasting system in which audio information signals are transmitted in the form of a FM audio information signal, has been put to practical use for a long time in the field of audio broadcasting, there has been recently proposed to introduce a digital audio broadcasting system in which audio information signals are transmitted in the form of a digital audio information signal for the purpose of improving quality of audio information transmitted or received in the system. Especially, in the European Continent, the digital audio broadcasting system called "DAB" has been already put to practical use in some countries.

It is expected that the digital audio broadcasting system would have great development henceforth so as to be in the mainstream in the field of audio broadcasting, in place of the analog audio broadcasting system, some time in the not so far future. However, at present, in a region wherein the digital audio broadcasting system has been already put to practical use or has been concretely planed to be materialized, a service area in which the digital audio information signal transmitted from a broadcasting station can be properly received is restricted to be relatively small. Therefore, in the case where the digital audio broadcasting is actually carried out, the analog audio broadcasting is also carried out, in addition to the digital audio broadcasting, so that the same program is transmitted through each of the digital audio broadcasting and the analog audio broadcasting at the same time.

In the analog audio broadcasting, the analog audio information signal, such as the AM or FM audio information signal, is transmitted from an analog signal broadcasting station in the form of the analog audio broadcasting signal, and in the digital audio broadcasting, the digital audio information signal is transmitted from a digital signal broadcasting station in the form of the digital audio broadcasting signal. The digital audio broadcasting signal transmitted in the digital audio broadcasting contains audio information data which represents audio information. Such audio information data are usually subjected to a time interleaving arrangement for the purpose of minimizing deterioration resulting from data bit omission, data bit transformation and so on.

The audio information data are transmitted in the form of a series of unit segments each having a time duration of, for example, 24 ms and constituting a logical frame. The time interleaving arrangement to which the audio information data are subjected is carried out with an interleaving completion segment consisting of successive sixteen logical frames. Accordingly, time interleaved audio information data corresponding to each group of successive sixteen original logical frames constitute successive sixteen new logical frames. This means that the time interleaved audio information data are provided with a relatively long delay time, such as more than 400 ms, which is longer than a time corresponding to successive sixteen original logical frames. Consequently, it is understood that the audio information data contained in the digital audio broadcasting signal transmitted from the digital signal broadcasting station has been provided with the relatively long delay time of, for example, 400 ms.

Under such a situation as mentioned above, it has been proposed to use an analog/digital broadcasting signal receiver which is an apparatus for receiving both the analog audio broadcasting signal transmitted from the analog signal broadcasting station and the digital audio broadcasting signal transmitted from the digital signal broadcasting station in an area in which both of the analog audio broadcasting and the digital audio broadcasting are put into practice. The analog/digital broadcasting signal receiver comprises an analog audio broadcasting signal receiving portion for receiving the analog audio broadcasting signal and obtaining a reproduced sound signal based on the received analog audio broadcasting signal (a reproduced analog broadcasting sound signal), a digital audio broadcasting signal receiving portion for receiving the digital audio broadcasting signal and obtaining a reproduced sound signal based on the received digital audio broadcasting signal (a reproduced digital broadcasting sound signal), and a reproduced signal selecting portion for deriving selectively the reproduced analog broadcasting sound signal and the reproduced digital broadcasting sound signal.

In the digital audio broadcasting signal receiving portion of the analog/digital broadcasting signal receiver, the audio information data contained in the received digital audio broadcasting signal are subjected to various signal processings so that the reproduced digital broadcasting sound signal is obtained. One of these signal processings to which the audio information data contained in the received digital audio broadcasting signal are subjected is a time de-interleaving arrangement for releasing the audio information data from the time interleaving arrangement to revert to original audio information data. The time de-interleaving arrangement to which the audio information data contained in the received digital audio broadcasting signal are subjected is carried out to each group of successive sixteen logical frames constituting the interleaving completion segment. That is, sixteen logical frames are successively derived from each of the interleaving completion segments of the audio information data contained in the received digital audio broadcasting signal to be stored in a memory device, and after those sixteen logical frames are once stored in the memory device, each of them is read from the memory device in a predetermined deinterleaving manner so that the time de-interleaving arrangement is carried out to each of the interleaving completion segments of the audio information data contained in the received digital audio broadcasting signal.

Meanwhile, in the analog audio broadcasting signal receiving portion of the analog/digital broadcasting signal receiver, the received analog audio broadcasting signal is subjected to a demodulation processing and other signal processings, for example, a frequency-demodulation processing, a de-emphasis processing and so on in case of the FM audio broadcasting signal, so that the reproduced analog broadcasting sound signal is obtained.

Then, the reproduced digital broadcasting sound signal obtained from the digital audio broadcasting signal receiving portion and the reproduced analog broadcasting sound signal obtained from the analog audio broadcasting signal receiving portion are selectively derived through the reproduced signal selecting portion in such a manner that the reproduced digital broadcasting sound signal is selected when it is obtained appropriately and the reproduced analog broadcasting sound signal is selected when the reproduced digital broadcasting sound signal is not obtained appropriately.

In the analog/digital broadcasting signal receiver as described above, since the time de-interleaving arrangement is carried out to each group of successive sixteen logical frames constituting the interleaving completion segment of the audio information data contained in the received digital audio broadcasting signal in the digital audio broadcasting signal receiving portion, the time de-interleaved audio information data obtained in the digital audio broadcasting signal receiving portion are provided with a delay time which is longer than a time corresponding to the group of successive sixteen logical frame. Consequently, the reproduced digital broadcasting sound signal obtained based on the audio information data contained in the received digital audio broadcasting signal from the digital audio broadcasting signal receiving portion has a relatively long delay time, such as more than 400 ms, which has been caused mainly by the time de-interleaving arrangement carried out in the digital audio broadcasting signal receiving portion.

On the other hand, the reproduced analog broadcasting sound signal which is obtained based on the received digital audio broadcasting signal subjected to the demodulation processing and other signal processings, for example, the frequency-demodulation processing, the de-emphasis processing and so on in case of the FM audio broadcasting signal, from the analog audio broadcasting signal receiving portion has a relatively short delay time, such as less than several tens $\mu$s, which has been caused mainly by the signal processings carried out in the analog audio broadcasting signal receiving portion.

Accordingly, when the digital audio broadcasting signal transmitted from the digital signal broadcasting station and the analog audio broadcasting signal transmitted from the analog signal broadcasting station are received respectively by the digital audio broadcasting signal receiving portion and the analog audio broadcasting signal receiving portion of the analog/digital broadcasting signal receiver under a situation in which the same program is transmitted from each of the digital signal broadcasting station and the analog signal broadcasting station at the same time, the reproduced digital broadcasting sound signal and the reproduced analog broadcasting sound signal, each of which represents the same sound information, are obtained with a relatively large time difference between each other from the digital audio broadcasting signal receiving portion and the analog audio broadcasting signal receiving portion, respectively. That is, first, the reproduced analog broadcasting sound signal with a relatively short delay time is obtained from the analog audio broadcasting signal receiving portion, and then, the reproduced digital broadcasting sound signal with a relatively long delay time, which represents the same audio information as that represented by the reproduced analog broadcasting sound signal, is obtained from the digital audio broadcasting signal receiving portion.

In such a case, the relatively long delay time with which the reproduced digital broadcasting sound signal has as explained above results in the sum of the relatively long delay time, such as 400 ms, which the audio information data contained in the digital audio broadcasting signal has been provided when it is received by the digital audio broadcasting signal receiving portion and another relatively long delay time, such as 400 ms, which is caused in the digital audio broadcasting signal receiving portion, and therefore, reaches to, for example, 800 ms.

The above mentioned operation by which the reproduced digital broadcasting sound signal and the reproduced analog broadcasting sound signal each representing the same sound information are obtained with the relatively large time difference between each other from the digital audio broadcasting signal receiving portion and the analog audio broadcasting signal receiving portion, respectively, brings disadvantages on the analog/digital broadcasting signal receiver as described below.

When the analog/digital broadcasting signal receiver is equipped to a vehicle and moved with the vehicle from a position in a condition wherein the reproduced analog broadcasting sound signal is obtained appropriately from the digital audio broadcasting signal receiving portion to another position in a condition wherein the reproduced analog broadcasting sound signal is not obtained appropriately from the digital audio broadcasting signal receiving portion and thereby the signal selection by the reproduced signal selecting portion is changed from the reproduced digital broadcasting sound signal to the reproduced analog broadcasting sound signal, a discontinuation of signal resulting from the relatively large time difference is caused between the reproduced digital broadcasting sound signal which had been derived before the change in the signal selection by the reproduced signal selecting portion and the reproduced analog broadcasting sound signal which is derived after the change in the signal selection by the reproduced signal selecting portion. This results in deterioration in quality of the reproduced sound signals obtained from the analog/digital broadcasting signal receiver.

Such a discontinuation of signal between the reproduced digital broadcasting sound signal and the reproduced analog broadcasting sound signal is also caused when the signal selection by the reproduced signal selecting portion is changed from the reproduced analog broadcasting sound signal to the reproduced digital broadcasting sound signal.

OBJECTS AND SUMMARY OF THE INVENTION

Accordingly, it is an object of the present invention to provide an apparatus for receiving broadcasting signals, in which a digital audio broadcasting signal receiving portion for receiving a digital audio broadcasting signal to obtain a reproduced digital broadcasting sound signal and an analog audio broadcasting signal receiving portion for receiving an analog audio broadcasting signal to obtain a reproduced analog broadcasting sound signal are provided, and which avoids the aforementioned disadvantages encountered with the prior art.

Another object of the present invention is to provide an apparatus for receiving broadcasting signals, in which a digital audio broadcasting signal receiving portion for receiving a digital audio broadcasting signal to obtain a reproduced digital broadcasting sound signal and an analog audio broadcasting signal receiving portion for receiving an analog audio broadcasting signal to obtain a reproduced digital broadcasting sound signal are provided, and which can prevent the reproduced digital and analog broadcasting sound signals each representing the same sound information from being derived selectively with a relatively large time difference between each other from the digital and analog audio broadcasting signal receiving portions.

A further object of the present invention is to provide an apparatus for receiving broadcasting signals, in which a digital audio broadcasting signal receiving portion for receiving a digital audio broadcasting signal to obtain a reproduced digital broadcasting sound signal and an analog audio broadcasting signal receiving portion for receiving an analog audio broadcasting signal to obtain a reproduced analog broadcasting sound signal are provided, and which can prevent the reproduced digital and analog broadcasting sound signals each representing the same sound information from being derived successively with a discontinuation of signal between each other from the digital and analog audio broadcasting signal receiving portions.

A still further object of the present invention is to provide an apparatus for receiving broadcasting signals, in which a digital audio broadcasting signal receiving portion for receiving a digital audio broadcasting signal to obtain a reproduced digital broadcasting sound signal and an analog audio broadcasting signal receiving portion for receiving an analog audio broadcasting signal to obtain a reproduced analog broadcasting sound signal are provided, and which is operative to delay the reproduced analog broadcasting sound signal obtained from the analog audio broadcasting signal receiving portion so as to coincide in time substantially with the reproduced digital broadcasting sound signal obtained from the digital audio broadcasting signal receiving portion.

According to the present invention, there is provided an apparatus for receiving broadcasting signals, which comprises a digital audio broadcasting signal receiving portion for receiving a digital audio broadcasting signal to obtain a reproduced digital broadcasting sound signal, an analog audio broadcasting signal receiving portion for receiving an analog audio broadcasting signal to obtain a reproduced analog broadcasting sound signal, a variable delay portion for delaying the reproduced analog broadcasting sound signal obtained from the analog audio broadcasting signal receiving portion to have a variable delay time, and a signal matching control portion for controlling the variable delay portion to reduce a difference in delay time between the reproduced analog broadcasting sound signal obtained through the variable delay portion and the reproduced digital broadcasting sound signal obtained from the digital audio broadcasting signal receiving portion.

In the apparatus for receiving broadcasting signals thus constituted in accordance with the present invention, under a situation wherein the reproduced digital and analog broadcasting sound signals are obtained respectively from the digital and analog audio broadcasting signal receiving portions, the analog broadcasting sound signal obtained from the analog audio broadcasting signal receiving portion is delayed by the variable delay portion to have the variable delay time and the variable delay portion is controlled by the signal matching control portion so as to reduce the difference in delay time between the reproduced analog broadcasting sound signal obtained through the variable delay portion and the reproduced digital broadcasting sound signal obtained from the digital audio broadcasting signal receiving portion.

Accordingly, even though the reproduced digital and analog broadcasting sound signals are obtained respectively from the digital and analog audio broadcasting signal receiving portions with a relatively large difference in delay time between each other, the difference in delay time between the reproduced digital broadcasting sound signal obtained from the digital audio broadcasting signal receiving portion and the reproduced analog broadcasting sound signal obtained through the variable delay portion is reduced to be, for example, substantially zero. As a result, when the reproduced digital broadcasting sound signal obtained from the digital audio broadcasting signal receiving portion and the reproduced analog broadcasting sound signal obtained through the variable delay portion are derived selectively to be used for reducing sound, a discontinuation of signal resulting from a time difference between the reproduced digital and analog broadcasting sound signals derived selectively is not caused substantially or is sharply reduced.

Consequently, with the apparatus for receiving broadcasting signals according to the present invention, it is possible to avoid such disadvantages that the reproduced digital and analog broadcasting sound signals each representing the same sound information are derived with a relatively large time difference between each other from the digital and analog audio broadcasting signal receiving portions, respectively, and a discontinuation of signal resulting from the relatively large time difference is caused between the reproduced digital and analog broadcasting sound signals derived successively.

The above, and other objects, features and advantages of the present invention will be become apparent from the following detailed description taken in conjunction with the accompanying drawings.

BRIEF DESCRIPTION OF THE DRAWINGS

FIGS. 2-A, 2-B and 2-C are block diagrams showing in detail the embodiment shown in FIG. 1.

DESCRIPTION OF THE PREFERRED EMBODIMENT

Figure 1:
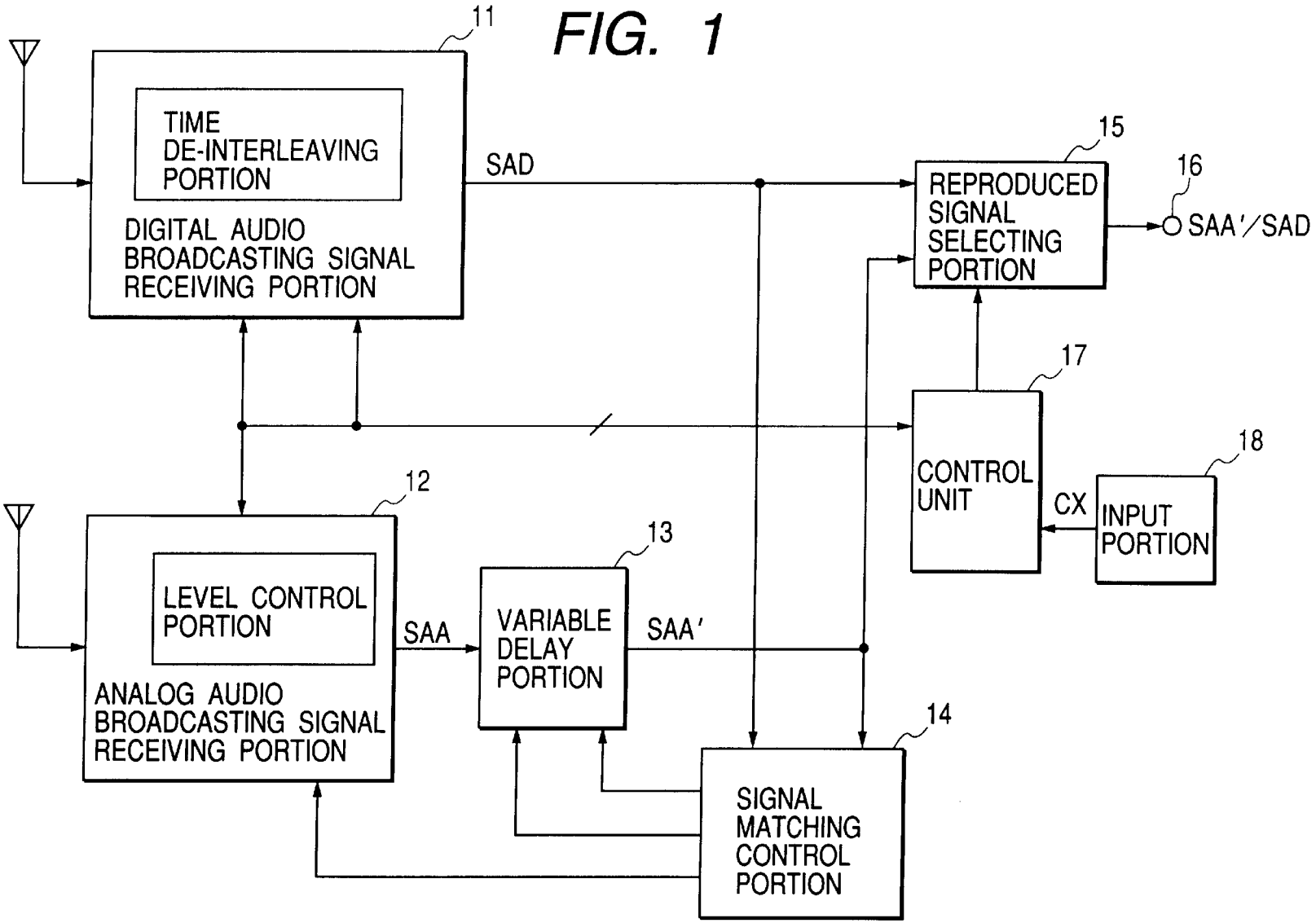
FIG. 1 is a block diagram showing schematically an embodiment of apparatus for receiving broadcasting signals according to the present invention.

FIG. 1 shows schematically an embodiment of apparatus for receiving broadcasting signals according to the present invention.

Referring to FIG. 1, the embodiment comprises of a digital audio broadcasting signal receiving portion 11, an analog audio broadcasting signal receiving portion 12, a variable delay portion 13, a signal matching control portion 14, a reproduced signal selecting portion 15, an output terminal 16, a control unit 17 and an input portion 18.

The digital audio broadcasting signal receiving portion 11 is operative to tune in to a digital audio broadcasting signal transmitted from a digital signal broadcasting station for receiving the same. In the digital audio broadcasting signal receiving portion 11, audio information data contained in the received digital audio broadcasting signal are subjected to a time de-interleaving arrangement by a time de-interleaving portion to produce a reproduced digital broadcasting sound signal SAD constituted with time de-interleaved audio information data as a first reproduced sound signal.

The analog audio broadcasting signal receiving portion 12 is operative to tune into an analog audio broadcasting signal, for example, an FM audio broadcasting signal transmitted from an analog signal broadcasting station for receiving the same. In the analog audio broadcasting signal receiving portion 12, the received FM audio broadcasting signal is subjected to a demodulation processing, a de-emphasis processing, a level control by a level control portion and so on to produce a reproduced analog broadcasting sound signal SAA as a second reproduced sound signal.

The variable delay portion 13 is operative to delay the reproduced analog broadcasting sound signal SAA (the second reproduced sound signal) obtained from the analog audio broadcasting signal receiving portion 12 to have a variable delay time for producing a delayed reproduced analog broadcasting sound signal SAA' which is the reproduced analog broadcasting sound signal SAA obtained through the variable delay portion 13. The variable delay time which the variable delay portion 13 provides the reproduced analog broadcasting sound signal SAA with is controlled by the signal matching control portion 14.

The signal matching control portion 14 is operative to detect a difference in delay time and a difference in level between the reproduced digital broadcasting sound signal SAD (the first reproduced sound signal) obtained from the digital audio broadcasting signal receiving portion 11 and the delayed reproduced analog broadcasting sound signal SAA' obtained through the variable delay portion 13. The signal matching control portion 14 is also operative to control, in response to a detection output of the difference in delay time between the reproduced digital broadcasting sound signal SAD and the delayed reproduced analog broadcasting sound signal SAA', the variable delay time which the variable delay portion 13 provides the reproduced analog broadcasting sound signal SAA with so as to reduce the difference in delay time between the reproduced digital broadcasting sound signal SAD and the delayed reproduced analog broadcasting sound signal SAA' and to control, in response to a detection output of the difference in level between the reproduced digital broadcasting sound signal SAD and the delayed reproduced analog broadcasting sound signal SAA', the level control portion in the analog audio broadcasting signal receiving portion 12 so as to reduce the difference in level between the reproduced digital broadcasting sound signal SAD and the delayed reproduced analog broadcasting sound signal SAA'.

The reproduced signal selecting portion 15 is operative to derive selectively the reproduced digital broadcasting sound signal SAD obtained from the digital audio broadcasting signal receiving portion 11 and the delayed reproduced analog broadcasting sound signal SAA' obtained through the variable delay portion 13 to the output terminal 16.

The control unit 17 is operative to perform control operations to the digital audio broadcasting signal receiving portion 11, the analog audio broadcasting signal receiving portion 12 and the reproduced signal selecting portion 15 in response to various command signals CX supplied from the input portion 18. In the control operation to the digital audio broadcasting signal receiving portion 11, various data are exchanged between the control unit 17 and the digital audio broadcasting signal receiving portion 11 and control signals are supplied to the digital audio broadcasting signal receiving portion 11 from the control unit 17. In the control operation to the analog audio broadcasting signal receiving portion 12, control signals are supplied to the analog audio broadcasting signal receiving portion 12 from the control unit 17. In the control operation to the reproduced signal selecting portion 15, the reproduced signal selecting portion 15 is caused by the control unit 17 to derive selectively the reproduced digital broadcasting sound signal SAD and the delayed reproduced analog broadcasting sound signal SAA'.

With such a structural arrangement, each of the difference in delay time and the difference in level between the reproduced digital broadcasting sound signal SAD obtained from the digital audio broadcasting signal receiving portion 11 and the delayed reproduced analog broadcasting sound signal SAA' obtained through the variable delay portion 13, both of which are supplied to the reproduced signal selecting portion 15, is reduced to be, for example, substantially zero. Then, to the output terminal 16, for example, the reproduced digital broadcasting sound signal SAD supplied from the digital audio broadcasting signal receiving portion 11 to the reproduced signal selecting portion 15 is derived when the reproduced digital broadcasting sound signal SAD is obtained appropriately from the digital audio broadcasting signal receiving portion 11 and the delayed reproduced analog broadcasting sound signal SAA' supplied through the variable delay portion 13 to the reproduced signal selecting portion 15 is derived in place of the reproduced digital broadcasting sound signal SAD when the reproduced digital broadcasting sound signal SAD is not obtained appropriately from the digital audio broadcasting signal receiving portion 11.

FIGS. 2-A, 2-B and 2-C show in detail structures of the digital audio broadcasting signal receiving portion 11, the analog audio broadcasting signal receiving portion 12 , the variable delay portion 13 and the signal matching control portion 14.

Referring to FIG. 2-A, in the digital audio broadcasting signal receiving portion 11, the digital audio broadcasting signal having reached to an antenna 21 is received through a tuning operation by a tuner 22. The tuning operation by the tuner 22 is performed in response to a tuning control signal STD supplied from the control unit 17. In the tuner 22, the received digital audio broadcasting signal is subjected to an amplifying processing and a frequency-converting processing to produce an intermediate frequency (IF) signal SID. The IF signal SID is supplied to an analog to digital (A/D) convertor 23.

A digital IF signal DID corresponding to the IF signal SID is obtained from the A/D convertor 23 to be supplied to a quadrature demodulator 24. In the quadrature demodulator 24, the digital IF signal DID is subjected to a quadrature demodulation processing to produce I and Q signals DI and DQ which are a pair of quadrature demodulated output signals.

The I and Q signals DI and DQ obtained from the quadrature demodulator 24 are supplied to a first Fourier transform (FFT) differential demodulator 25. In the FFT differential demodulator 25, each of the I and Q signals DI and DQ is subjected to transformation from a time domain signal to a frequency domain signal to produce control information data DCD representing control information transmitted through the Fast Information Channel (FIC) and audio information data DAD representing audio information transmitted through the Main Service Channel (MSC). The audio information data DAD have been time interleaved and provided with a relatively long delay time, such as more than 400 ms, which has been caused mainly by the time interleaving arrangement carried out in the digital signal broadcasting station.

The control information data DCD obtained from the FFT differential demodulator 25 are supplied directly to a Vitervi decoder 26. The audio information data DAD obtained from the FFT differential demodulator 25 are subjected to a program selection processing by which a required program is extracted in a program selector 27 and supplied to a time de-interleaving portion 28. The program selection processing in the program selector 27 is performed in accordance with a program selection control signal SSP supplied from the control unit 17.

In the time de-interleaving portion 28, the audio information data DAD supplied through the program selector 27 are subjected to a time de-interleaving arrangement. This time de-interleaving arrangement is carried out to each group of successive sixteen logical frames each having a time duration of, for example, 24 ms and constituting an interleaving completion segment of the audio information data DAD which have been time interleaved. On that occasion, the sixteen logical frames constituting the interleaving completion segment of the audio information data DAD are successively derived to be stored in a memory 29, and after those sixteen logical frames are once stored in the memory 29, each of them is read from the memory 29 in a predetermined deinterleaving manner so that the time de-interleaving arrangement is carried out to each of the interleaving completion segments of the audio information data DAD. Then, time de-interleaved audio information data DAD' are obtained from the time de-interleaving portion 28.

The time de-interleaved audio information data DAD' thus obtained is provided with a relatively long delay time, such as more than 400 ms, which is caused by the time de-interleaving arrangement to which the audio information data DAD from the program selector 27 is subjected in the time de-interleaving portion 28, in addition to the relatively long delay time, such as more than 400 ms, of the audio information data DAD. This means that the time de-interleaved audio information data DAD' has totally a relatively long delay time, such as more than 800 ms.

The time de-interleaved audio information data DAD' obtained from the time de-interleaving portion 28 are supplied to the Vitervi decoder 26. In the Vitervi decoder 26, the control information data DCD from the FFT differential demodulator 25 and the time de-interleaved audio information data DAD' from the time de-interleaving portion 28 are subjected respectively to error correction processings. The time de-interleaved audio information data DAD' subjected to the error correction processing are supplied from the Vitervi decoder 26 to a high efficiency decoder 30 and the control information data DCD subjected to the error correction processing are supplied from the Vitervi decoder 26 to the control unit 17.

In the high efficiency decoder 30, the time de-interleaved audio information data DAD' subjected to the error correction processing are further subjected to a high efficiency decoding by which data suppressed in accordance with a high efficiency coding are expanded to produce decoded audio data DA. Further, program associated data DPA which are contained in the time de-interleaved audio information data DAD' are obtained from the high efficiency decoder 30 to be supplied to the control unit 17. The control unit 17 is operative to produce control data DVD based on the control information data DCD from the Vitervi decoder 26, the program associated data DPA from the high efficiency decoder 30 and so on and to supply the Vitervi decoder 26 with the control data DVD for performing a control operation to the Vitervi decoder 26.

The decoded audio data DA obtained from the high efficiency decoder 30 are supplied to a digital to analog (D/A) convertor 31 to be converted to an analog sound signal corresponding to the decoded audio data DA. This analog sound signal is supplied to the reproduced signal selecting portion 15 and the signal matching control portion 14 as the reproduced digital broadcasting sound signal SAD. Since the time de-interleaved audio information data DAD' obtained from the time de-interleaving portion 28 has the relatively long delay time, such as more than 800 ms, as aforementioned, the reproduced digital broadcasting sound signal SAD obtained from the digital audio broadcasting signal receiving portion 11 as described above has also a relatively long delay time, such as more than 800 ms.

Meanwhile, in the analog audio broadcasting signal receiving portion 12 shown in FIG. 2-B, the analog audio broadcasting signal having reached to an antenna 41 is received through a tuning operation by a tuner 42. The tuning operation by the tuner 42 is performed in response to a tuning control signal STA supplied from the control unit 17. In the tuner 42, the received analog audio broadcasting signal is subjected to an amplifying processing and a frequency-converting processing to produce an intermediate frequency (IF) signal SIA. The IF signal SIA is amplified by an IF amplifier 43 and supplied to a frequency-demodulator 44.

In the frequency-demodulator 44, the IF signal DIA is subjected to a FREQUENCY-demodulation processing to produce a demodulated audio signal SA. The demodulated audio signal SA obtained from the frequency-demodulator 44 is supplied to a de-emphasis portion 45 to be subjected to the de-emphasis processing and thereby to produce a reproduced sound signal SA'.

The reproduced sound signal SA' obtained from the de-emphasis portion 45 is supplied to a level control portion 46. In the level control portion 46, the level of the reproduced sound signal SA' is controlled in accordance with a level control signal SCL supplied from a signal matching control unit 50 provided in the signal matching control portion 14 to the level control portion 46. The reproduced sound signal SA' with its level controlled in the level control portion 46 is derived from the analog audio broadcasting signal receiving portion 12 as the reproduced analog broadcasting sound signal SAA.

The reproduced analog broadcasting sound signal SAA thus obtained from the analog audio broadcasting signal receiving portion 12 is supplied to the variable delay portion 13. In the variable delay portion 13, the reproduced analog broadcasting sound signal SAA is converted to a digital sound signal DAA in an A/D convertor 47 to be stored in a memory 48. The storage of the digital sound signal DAA in the memory 48 is carried out in accordance with a storage control signal QW supplied from a memory control portion 51 provided in the signal matching control portion 14 to the memory 48.

Further, in the variable delay portion 13, the digital sound signal DAA stored in the memory 48 is read from the memory 48 as a digital sound signal DAA'. The reading of the digital sound signal DAA from the memory 48 is carried out in accordance with a reading control signal QR supplied from the memory control portion 51 provided in the signal matching control portion 14 to the memory 48.

The digital sound signal DAA' thus obtained from the memory 48 is provided a delay time corresponding a time from the storage of the digital sound signal DAA in the memory 48 to the reading of the digital sound signal DAA from the memory 48, compared with the digital sound signal DAA obtained from the A/D convertor 47. Then, the digital sound signal DAA' obtained from the memory 48 is converted to an analog sound signal corresponding to the digital sound signal DAA' in a D/A convertor 49 and this analog sound signal obtained from the D/A convertor 49 is derived from the variable delay portion 13 as the delayed reproduced analog broadcasting sound signal SAA'.

The delayed reproduced analog broadcasting sound signal SAA' thus obtained through the variable delay portion 13 is supplied to the reproduced signal selecting portion 15 and the signal matching control portion 14. This delayed reproduced analog broadcasting sound signal SAA' is provided with the delay time of the digital sound signal DAA' from the memory 48, which corresponds to the time from the storage of the digital sound signal DAA in the memory 48 to the reading of the digital sound signal DAA from the memory 48, in addition to a relatively short delay time, such as less than several tens μs, of the reproduced analog broadcasting sound signal SAA, which is caused mainly by the frequency-demodulation processing to which the IF signal SIA is subjected and the de-emphasis processing to which the demodulated audio signal SA is subjected.

In the signal matching control portion 14 shown in FIG. 2-C, the reproduced digital broadcasting sound signal SAD obtained from the digital audio broadcasting signal receiving portion 11 is subjected to an envelope detection in a detecting rectifier 53 and a detection output signal SED corresponding to the envelope wave form of the reproduced digital broadcasting sound signal SAD is obtained from the detecting rectifier 53. Further, the delayed reproduced analog broadcasting sound signal SAA' obtained through the variable delay portion 13 is subjected to an envelope detection in a detecting rectifier 54 and a detection output signal SEA corresponding to the envelope wave form of the delayed reproduced analog broadcasting sound signal SAA' is obtained from the detecting rectifier 54.

The detection output signal SED obtained from the detecting rectifier 53 and the detection output signal SEA obtained from the detecting rectifier 54 are supplied to a comparator 55. In the comparator 55, the envelope wave form of the reproduced digital broadcasting sound signal SAD and the envelope wave form of the delayed reproduced analog broadcasting sound signal SAA' are compared with each other based on the detection output signals SED and SEA. As a result, a comparison output signal SOT corresponding to a difference between the envelope wave form of the reproduced digital broadcasting sound signal SAD and the envelope wave form of the delayed reproduced analog broadcasting sound signal SAA' is obtained from the comparator 55.

The comparison output signal SOT thus obtained from the comparator 55 represents a difference in delay time between the reproduced digital broadcasting sound signal SAD and the delayed reproduced analog broadcasting sound signal SAA'. Accordingly, the detecting rectifiers 53 and 54 and the comparator 55 constitute a time difference detecting portion for detecting the difference in delay time between the reproduced digital broadcasting sound signal SAD obtained from the digital audio broadcasting signal receiving portion 11 and the delayed reproduced analog broadcasting sound signal SAA' obtained through the variable delay portion 13 and this time difference detecting portion produces the comparison output signal SOT as a detection output signal.

The comparison output signal SOT is digitalized in an A/D convertor 56 to produce a digital signal DOT. The digital signal DOT corresponding to the comparison output signal SOT is supplied form the A/D convertor 56 to the signal matching control unit 50. The signal matching control unit 50 is operative to supply the memory control portion 51 with a memory control signal SCM which is formed based on the digital signal DOT in order to control the memory control portion 51 in such a manner that the storage control signal QW and the reading control signal QR supplied from the memory control portion 51 to the memory 48 are varied in response to the digital signal DOT and therefore the storage time of the digital sound signal DAA in the memory 48, namely, the delay time which the digital sound signal DAA is provided within the variable delay portion 13 is so controlled as to reduce the difference in delay time between the reproduced digital broadcasting sound signal SAD and the delayed reproduced analog broadcasting sound signal SAA' to be, for example, substantially zero.

Further, in the signal matching control portion 14, a low frequency component of the reproduced digital broadcasting sound signal SAD obtained from the digital audio broadcasting signal receiving portion 11 is extracted to detect an average level of the reproduced digital broadcasting sound signal SAD in a low pass filter (LPF) 58 and a detection output signal SLD corresponding to the average level of the reproduced digital broadcasting sound signal SAD is obtained from the LPF 58. Similarly, a low frequency component of the delayed reproduced analog broadcasting sound signal SAA' obtained through the variable delay portion 13 is extracted to detect an average level of the delayed reproduced analog broadcasting sound signal SAA' in a LPF 59 and a detection output signal SLA corresponding to the average level of the delayed reproduced analog broadcasting sound signal SAA' is obtained from the LPF 59.

The detection output signal SLD obtained from the LPF 58 and the detection output signal SLA obtained from the LPF 59 are supplied to a comparator 60. In the comparator 60, the average level of the reproduced digital broadcasting sound signal SAD and the average level of the delayed reproduced analog broadcasting sound signal SAA' are compared with each other based on the detection output signals SLD and SLA. As a result, a comparison output signal SOL corresponding to a difference between the average level of the reproduced digital broadcasting sound signal SAD and the average level of the delayed reproduced analog broadcasting sound signal SAA' is obtained from the comparator 60.

The comparison output signal SOL thus obtained from the comparator 60 represents a difference in level between the reproduced digital broadcasting sound signal SAD and the delayed reproduced analog broadcasting sound signal SAA'. Accordingly, the LPFs 58 and 59 and the comparator 60 constitute a level difference detecting portion for detecting the difference in level between the reproduced digital broadcasting sound signal SAD obtained from the digital audio broadcasting signal receiving portion 11 and the delayed reproduced analog broadcasting sound signal SAA' obtained through the variable delay portion 13 and this level difference detecting portion produces the comparison output signal SOL as a detection output signal.

The comparison output signal SOL is digitalized in an A/D convertor 61 to produce a digital signal DOL. The digital signal DOL corresponding to the comparison output signal SOL is supplied form the A/D convertor 61 to the signal matching control unit 50. The signal matching control unit 50 is operative to supply the level control portion 46 in the analog audio broadcasting signal receiving portion 12 with the level control signal SCL which is formed based on the digital signal DOL in order to control the level control portion 46 so as to reduce the difference in level between the reproduced digital broadcasting sound signal SAD and the delayed reproduced analog broadcasting sound signal SAA' to be, for example, substantially zero.

With such control operations to the variable delay portion 13 and the level control portion 46 in the analog audio broadcasting signal receiving portion 12, which are conducted by the signal matching control portion 14, each of the difference in delay time and the difference in level between the reproduced digital broadcasting sound signal SAD and the delayed reproduced analog broadcasting sound signal SAA' both supplied to the reproduced signal selecting portion 15 is reduced to be, for example, substantially zero.

As shown in FIG. 2-A, a selection control signal SSW which is produced in the control unit 17 in response to, for example, the command signal CX supplied from the input portion 18, is supplied to the reproduced signal selecting portion 15. The reproduced signal selecting portion 15 is operative, in accordance with the selection control signal SSW, to derive selectively the reproduced digital broadcasting sound signal SAD obtained from the digital audio broadcasting signal receiving portion 11 and the delayed reproduced analog broadcasting sound signal SAA' obtained through the variable delay portion 13 to the output terminal 16. Thereby, the reproduced digital broadcasting sound signal SAD is derived to the output terminal 16 when the reproduced digital broadcasting sound signal SAD is obtained appropriately from the digital audio broadcasting signal receiving portion 11 and the delayed reproduced analog broadcasting sound signal SAA' obtained through the variable delay portion 13 is derived to the output terminal 16 in place of the reproduced digital broadcasting sound signal SAD when the reproduced digital broadcasting sound signal SAD is not obtained appropriately from the digital audio broadcasting signal receiving portion 11.

In such a case, since each of the difference in delay time and the difference in level between the reproduced digital broadcasting sound signal SAD and the delayed reproduced analog broadcasting sound signal SAA' both supplied to the reproduced signal selecting portion 15 is reduced to be, for example, substantially zero, a discontinuation of signal between the reproduced digital broadcasting sound signal SAD and the delayed reproduced analog broadcasting sound signal SAA' derived selectively is not caused substantially or is sharply reduced when the signal selection by the reproduced signal selecting portion 15 is changed from the reproduced digital broadcasting sound signal SAD to the delayed reproduced analog broadcasting sound signal SAA' or from the delayed reproduced analog broadcasting sound signal SAA' to the reproduced digital broadcasting sound signal SAD.

What is claimed is:

1. An apparatus for receiving broadcasting signals comprising:

a digital audio broadcasting signal receiving portion for receiving a digital audio broadcasting signal and producing a first reproduced sound signal;

an analog audio broadcasting signal receiving portion for receiving an analog audio broadcasting signal and producing a second reproduced sound signal;

a variable delay portion for delaying said second reproduced sound signal by a variable delay time and outputting a delayed second reproduced sound signal; and a signal matching control portion for calculating a difference in delay time between said delayed second reproduced sound signal output from said variable delay portion and said first reproduced sound signal produced by said digital audio broadcasting signal receiving portion, and for controlling in response to said calculated difference in delay times said variable delay time of said variable delay portion to be substantially zero.

2. The apparatus for receiving broadcasting signals according to claim 1, wherein said signal matching control portion further includes comparing means for calculating a level difference between a first envelope waveform of said first reproduced sound signal produced by said digital audio broadcasting signal receiving portion and a second envelope waveform of said delayed second reproduced sound signal output from said variable delay portion, and for controlling in response to said calculated level difference said second reproduced sound signal produced by said analog audio broadcasting signal receiving portion so that said level difference is substantially zero.

3. The apparatus for receiving broadcasting signals according to claim 1, wherein said variable delay portion includes:

memory means for storing temporarily said second reproduced sound signal produced by said analog audio broadcasting signal receiving portion, and memory controlling means for controlling a storage time of said second reproduced sound signal in said memory means.

4. The apparatus for receiving broadcasting signals according to claim 1, wherein said analog audio broadcasting signal receiving portion includes level controlling means for controlling a level of said second reproduced sound signal, and said signal matching control portion controls said level controlling means so as to reduce a difference in level between said delayed second reproduced sound signal output from said variable delay portion and said first reproduced sound signal produced by said digital audio broadcasting signal receiving portion.

5. The apparatus for receiving broadcasting signals according to claim 4, wherein said signal matching control portion includes level difference detecting means for detecting said difference in level between said first reproduced sound signal produced by said digital audio broadcasting signal receiving portion and said delayed second reproduced sound signal output from said variable delay portion, and said signal matching control portion controls said level controlling means in response to a detection output signal obtained from said level difference detecting means so as to reduce said difference in level between said first reproduced sound signal and said second reproduced sound signal.

6. The apparatus for receiving broadcasting signals according to claim 5, wherein said level difference detecting means includes:

first and second low pass filters; and comparing means for comparing a level of an output signal from said first low pass filter having as an input said first reproduced sound signal produced by said digital audio broadcasting signal receiving portion with a level of an output signal from said second low pass filter having as an input said delayed second reproduced sound signal output from said variable delay portion, and a detection output signal obtained from said level difference detecting means is formed with a comparison output signal produced by said comparing means.

7. The apparatus for receiving broadcasting signals according to claim 1, wherein said digital audio broadcasting signal receiving portion includes time de-interleaving means for causing sound information data obtained from said digital audio broadcasting signal to be subjected to a time de-interleaving process, and said first reproduced sound signal is produced based on processed sound information data output from said time de-interleaving means.

8. The apparatus for receiving broadcasting signals according to claim 1, further comprising a reproduced signal selecting portion for selecting one of said first reproduced sound signal produced by said digital audio broadcasting signal receiving portion and said delayed second reproduced sound signal output from said variable delay portion.

* * * * *